United States Patent [19]

Woodruff

[11] 4,280,770

[45] Jul. 28, 1981

[54] APPARATUS FOR COMPACTING SOIL

[76] Inventor: Roy J. Woodruff, P.O. Box 10127, Bradenton, Fla. 33507

[21] Appl. No.: 42,438

[22] Filed: May 25, 1979

[51] Int. Cl.[3] ..... E01C 19/38

[52] U.S. Cl. ..... 404/133; 405/271

[58] Field of Search ..... 173/49; 404/133; 175/19, 55; 405/271

[56] References Cited

U.S. PATENT DOCUMENTS

| | | | |
|---|---|---|---|
| 3,379,263 | 4/1968 | Bodine | 175/19 |
| 3,543,525 | 12/1970 | Phares | 173/49 X |
| 3,603,224 | 9/1971 | Dresher | 404/133 |
| 3,865,501 | 2/1975 | Kniep | 404/133 |
| 4,112,692 | 9/1978 | Anderson et al. | 405/271 |

*Primary Examiner*—David H. Corbin

*Attorney, Agent, or Firm*—Oltsch, Knoblock & Hall

[57] ABSTRACT

A method of and apparatus for compacting backfill in pipe and sewer trenches. A trench is filled with earth after the pipe is laid and an open ended tube is vibrated and lowered endwise into the backfill overlying the pipe while the pipe is substantially filled with water. The apparatus utilizes a vibrator carried by a backhoe and an open ended rigid tube suspended from the vibrator.

7 Claims, 13 Drawing Figures

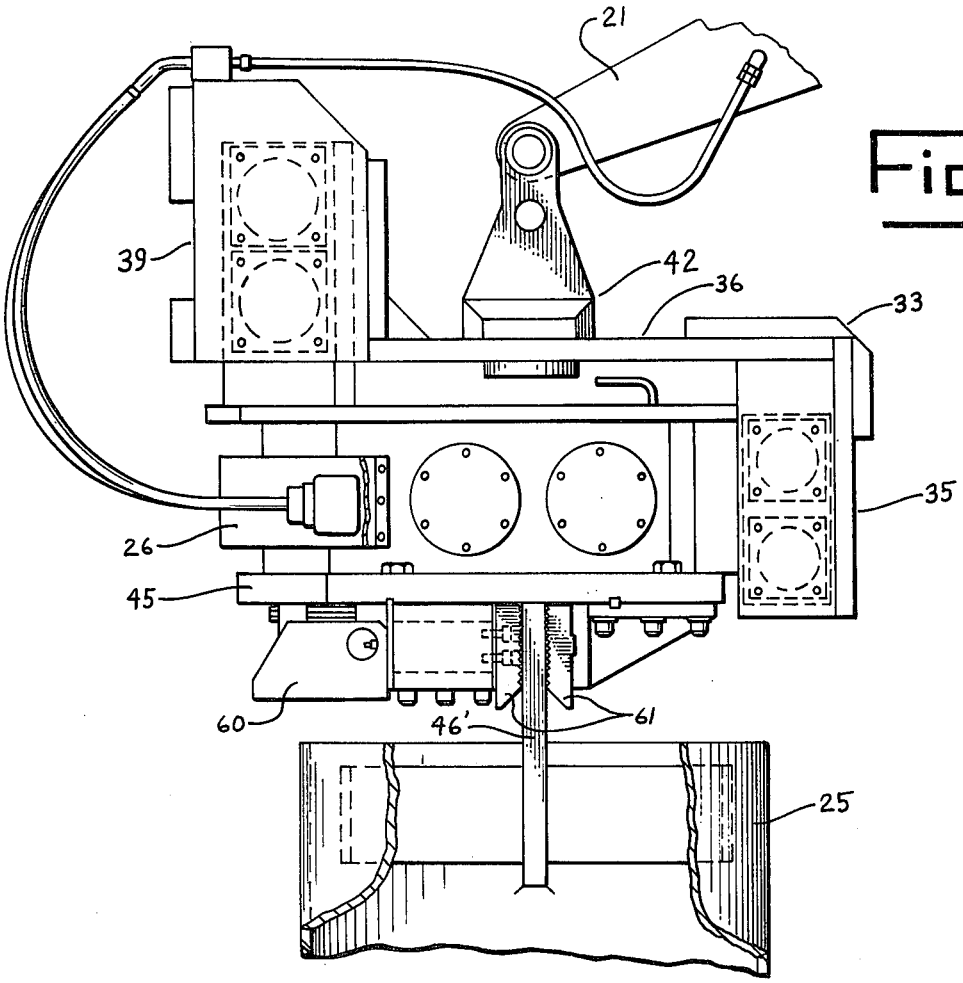
Fig. 12
Fig. 13
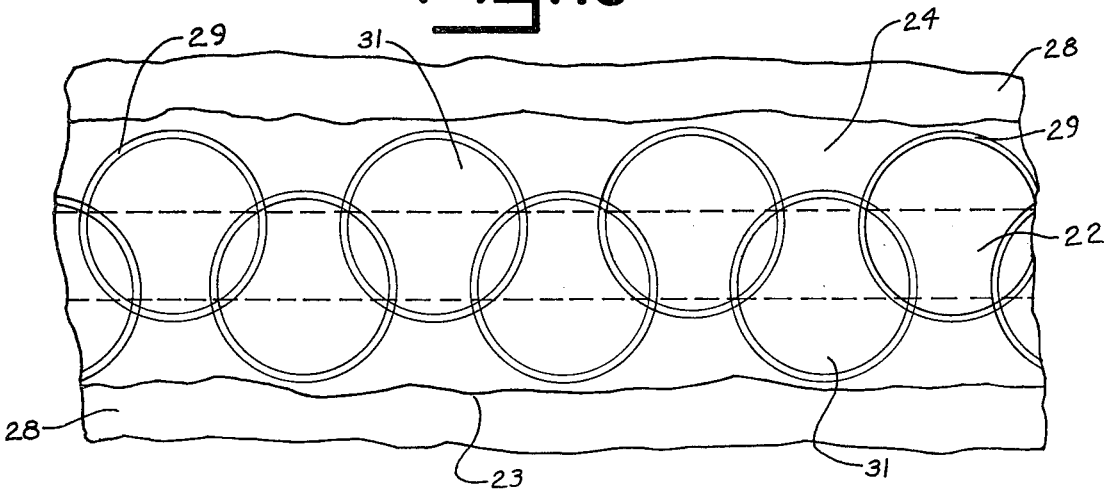

APPARATUS FOR COMPACTING SOIL

SUMMARY OF THE INVENTION

This invention relates to a method of and apparatus for compacting backfill in pipe and sewer trenches.

Heretofore it has been common practice in the laying of sewer pipes and other pipes in trenches to progressively and alternately partially backfill the trench, compact the partial backfill, apply another layer of backfill and compact that layer, and continue the procedure until the trench is filled. This practice is time consuming and may be dangerous in the event a trench wall collapses incident to compaction of a partly backfilled trench. Heretofore this practice has been deemed necessary in order to avoid objectionable settling of the backfill as experienced in previous attempts to completely fill a trench before compacting the backfill material. Prior attempts to backfill a trench completely with an excess above grade level, followed by rolling to approximate grade level, have resulted in settling of the backfill in a short time, thus providing a defective base for construction and paving thereover.

In the apparatus of this invention a vibrator head is employed to vibrate an open ended tube suspended endwise therefrom. The vibrating head is preferably anchored to and suspended from a backhoe arm by means of a structure incorporating vibration damping rubber mounts.

In the method of this invention the apparatus is employed to vibrate a vertically suspended open ended tube as it is lowered into the fill material to compact the backfill in a pipe or sewer trench while the underlying pipe has been weighted by substantially filling it with water. Displacement of the pipe or sewer line during vibration is prevented by the weight of the water fill.

Accordingly, it is an object of this invention to provide a method of compacting the backfill in sewer and pipe trenches rapidly and with greater safety than has been possible by prior methods and in a manner providing a firm base for construction thereover.

Another object of this invention is to provide a method of compacting backfill in sewer and pipe trenches without causing displacement of the pipe or disturbance of the grade or slope of the pipe.

Another object of this invention is to provide a method of compacting the backfill in sewer and pipe trenches which permits the compacting to be done without causing stress or leakage at joints in the pipe or sewer line.

Another object of this invention is to provide a method which permits complete filling of a trench and effective one-step compaction of the backfill in the trench.

Another object of this invention is to provide a simple apparatus for rapidly compacting backfill in sewer and pipe trenches which employs an open ended tube which is vibrated while it is lowered endwise into the backfill material.

Another object of this invention is to provide an apparatus for compacting backfill in sewer and pipe trenches which employs an hydraulically driven vibrator head.

Another object of this invention is to provide an apparatus for compacting backfill in sewer and pipe trenches while being guided and supported by a backhoe.

Another object of this invention is to provide an apparatus for compacting backfill in sewer and pipe trenches which is compact, easily transported and efficient in operation.

Other objects of this invention will become apparent from the following description.

BRIEF DESCRIPTION OF THE DRAWINGS

FIG. 12 is a fragmentary side elevational view of a modified embodiment of the compacting apparatus, with parts broken away.

FIG. 13 is a top fragmentary view of a compacted backfilled trench.

DESCRIPTION OF THE PREFERRED EMBODIMENTS

The preferred embodiments illustrated are not intended to be exhaustive nor to limit the invention to the precise forms disclosed. They are chosen and described to explain the principles of the invention and its application and practical use, to thereby enable others skilled in the art to best utilize the invention.

One embodiment of this invention is shown in which the apparatus is connected to a backhoe 20 having a multi-section hydraulically controlled pivoted arm 21.

Figure 1:
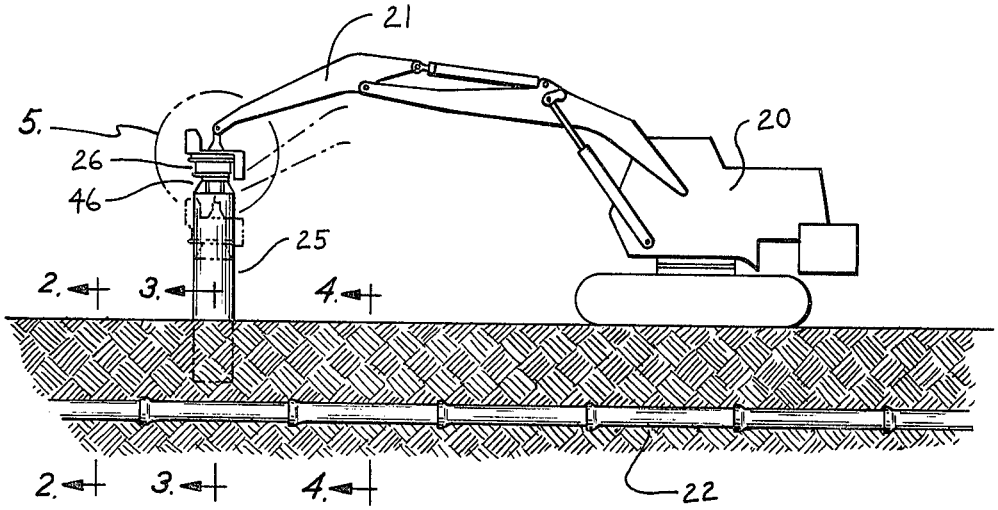
FIG. 1 is a side elevation view depicting the apparatus of this invention being used in association with a backhoe to compact backfill overlying a sewer pipe line.
Figure 2:
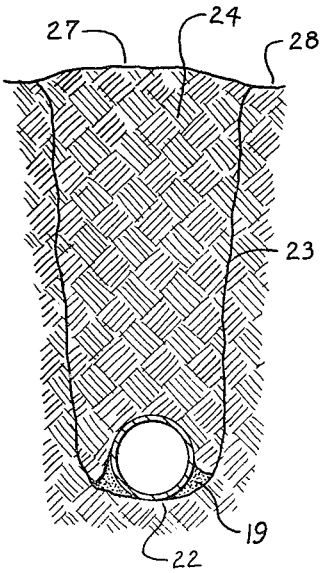
FIG. 2 is a vertical sectional view taken along line 2—2 of FIG. 1 and showing the backfill overlying the sewer pipe in its loose or uncompacted state.

In the laying of pipe and sewer lines 22 in a trench 23, the trench 23 is filled with earth after the pipe 22 is laid. The backfilled earth 24 overlying the pipe 22 must be compacted. Methods of compacting now common to the art include the advance of weighted rollers over the fill 24, impact tamping of successive layers of fill 24, or natural settling of the fill. Natural settling of fill 24 is usually impracticable, as when it is desired to commence construction or to lay paving material over a newly laid pipeline, or when it is undesirable to have the surface grade of the earth disturbed by a pile of backfill, as seen in FIG. 2. The use of heavy rollers traversing the fill 24 usually results in incomplete compaction of the backfill with resultant settling of the fill 24 over the pipeline with the passage of time. Impact tamping is time consuming and usually requires the successive tamping of the backfill in a number of layers over the pipe until the backfill reaches the level of the surrounding grade. Additionally, impact tamping of successive fill layers can result in shifting or displacement of the pipe, with resulting stress and damage to pipe joints causing leakage at the joints, and may cause collapse of trench walls.

Figure 3:
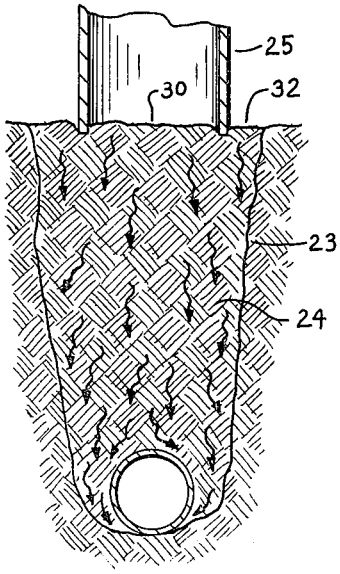
FIG. 3 is a vertical sectional view taken along line 3—3 of FIG. 1 and shows the lower end of the apparatus of this invention beginning to enter loose backfill at the start of the compacting operation.
Figure 4:
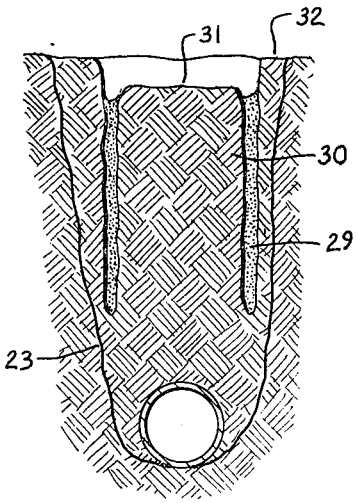
FIG. 4 is a vertical sectional view taken along line 4—4 of FIG. 1 showing compacted backfill following removal of the compacting apparatus.

In the method of this invention, a newly laid pipeline, such as a section of a sewer between manholes (not shown), is first substantially filled with water and usually is bedded at 19 by tamping. The trench is completely filled with earth 24 as seen in FIG. 2. A backhoe 20, or other apparatus, preferably a hydraulic backhoe, is used to transport and activate the apparatus of this invention at successive points along the filled pipeline trench as seen in FIG. 13 in a manner to subject substantially all or the major part of the backfill to compaction within member 25. An elongated open ended tubular member 25 is connected to and vibrationally driven by a vibrator head 26 while being lowered and maintained in vertical position upon and into the loose backfill 24 overlying the pipeline. As illustrated in FIG. 2 the loose backfill 24 may not completely surround the newly laid pipe 22 and it is piled at 27 to a level above the surrounding grade 28. The vibrating tubular member 25 is progressively lowered into the loose backfill 24 from a position illustrated in FIG. 3 to a position within the fill 24 adjacent but above pipe 22, as indicated at 29 shown in FIG. 4. As the tubular member 25 sinks into the backfill 24, vibration thereof is transmitted to the backfill 30 therein to lower its level at 31, and is also transmitted to the surrounding backfill 32. As illustrated in FIG. 4, the tubular member has been inserted into the backfill to a depth sufficient to compact the entire depth of backfill overlying the pipe and then was withdrawn with the space occupied by member 25 being filled by the vibrations as the member 25 is raised. During the vibration the pipe is secured against migration of backfill underneath it and against upward displacement in the fill 24 by the weight of the water contained in it, so that complete compacting of the overlying backfill occurs without disturbing the pipe.

The compaction of the loose backfilled earth 24 in the trench 23 will usually cause the surface fill level 31 in the trench within and around the tube 25 to be lower than the grade 28 of the surrounding earth. In such a case, additional fill earth is applied and rolled to obtain a uniform grade over the trench after the compacting operation.

Figure 5:
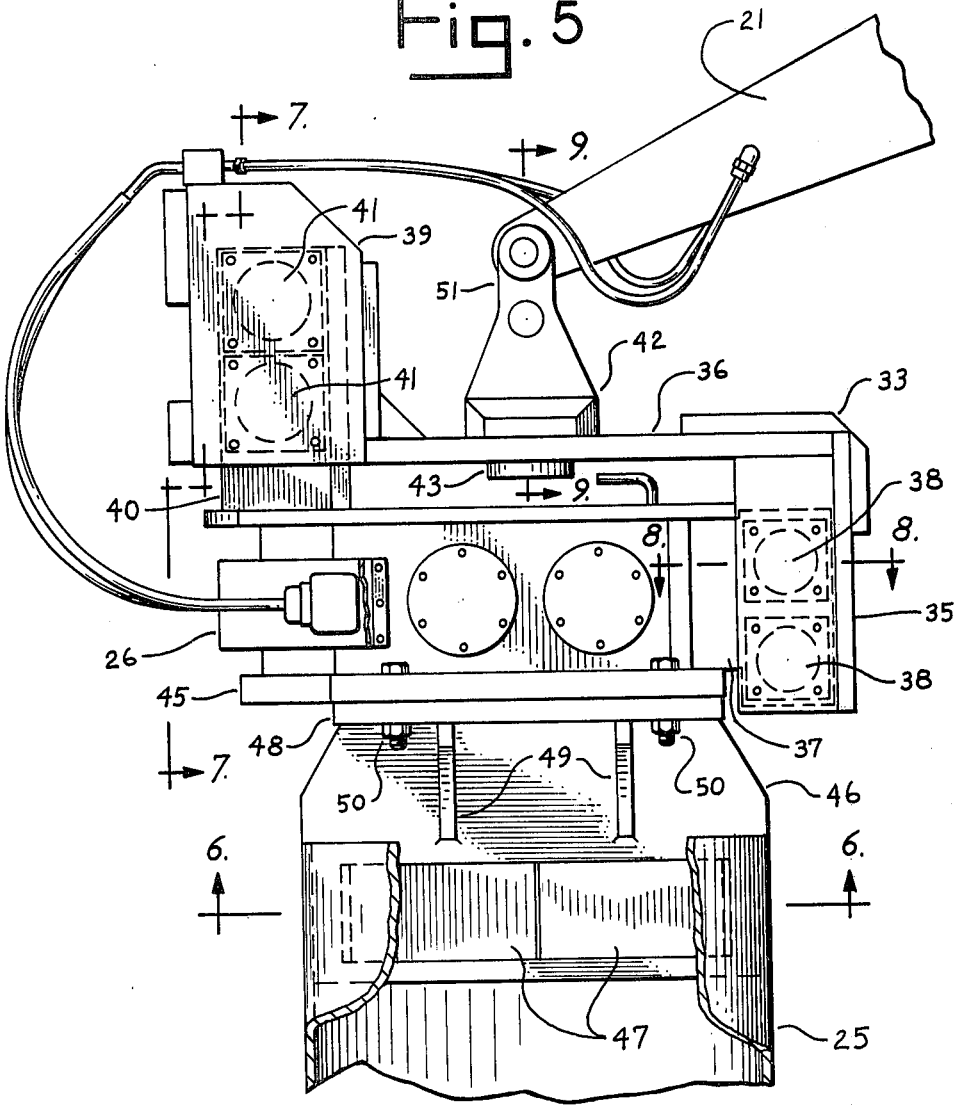
FIG. 5 is a fragmentary side elevational view of the apparatus of this invention with parts broken away.
Figure 6:
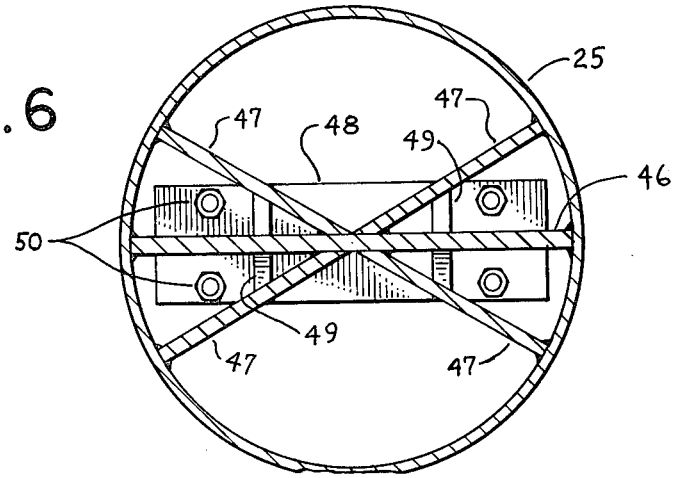
FIG. 6 is a horizontal sectional view taken along line 6—6 of FIG. 5.
Figure 7:
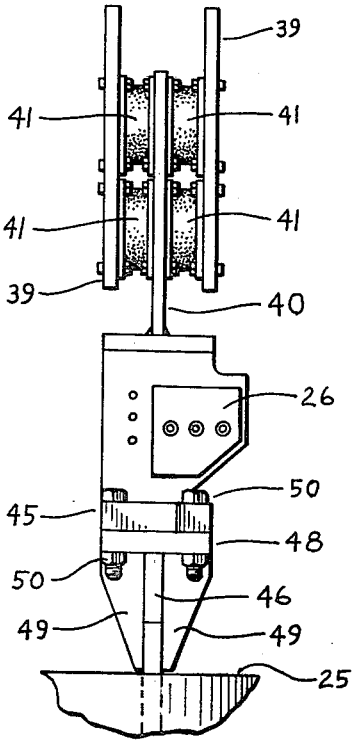
FIG. 7 is a fragmentary vertical sectional view taken along line 7—7 of FIG. 5.
Figure 8:
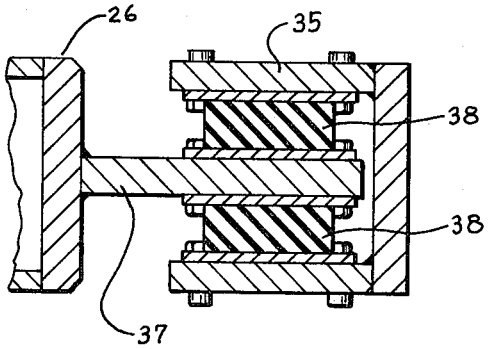
FIG. 8 is a horizontal sectional view taken along line 8—8 of FIG. 5.
Figure 9:
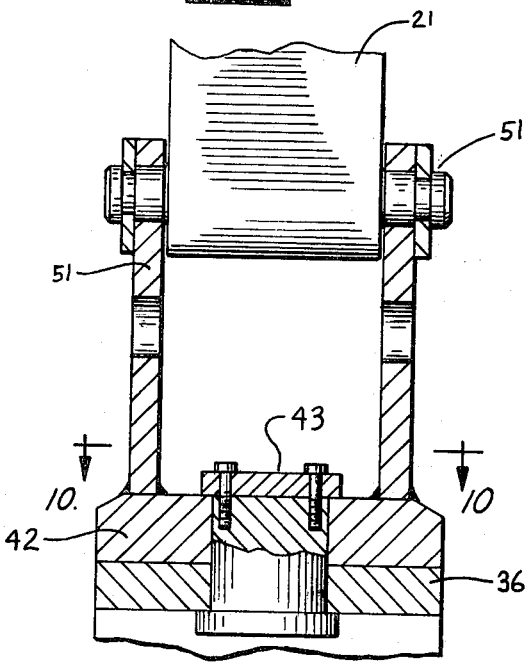
FIG. 9 is a fragmentary vertical sectional view taken along line 9—9 of FIG. 5.
Figure 10:
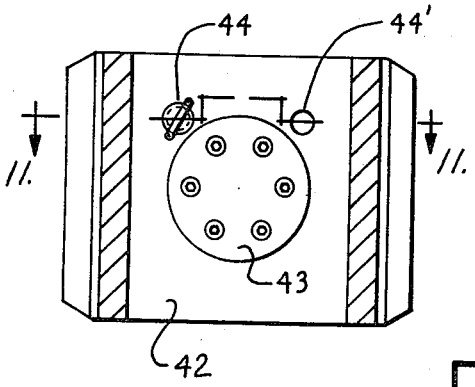
FIG. 10 is a horizontal sectional view taken along line 10—10 of FIG. 9.
Figure 11:
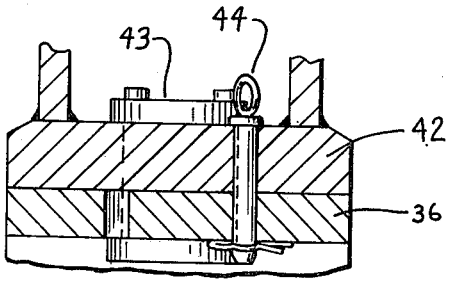
FIG. 11 is a vertical sectional view taken along the line 11—11 of FIG. 10.

FIG. 5 depicts one embodiment of the apparatus of this invention. The tubular member 25 is vibrationally driven by vibrating head 26. Vibrating head 26 may be any commercially available unit and preferably is a unit driven by an hydraulic motor connected to the hydraulic system of the backhoe. Within the housing of vibrating head 26 are two counter-rotating eccentric weights (not shown). These counter-rotating eccentric weights cause vibration in a substantially vertical direction. The tubular member 25 and vibrating head 26 are supported by a support structure frame 33. Frame 33 incorporates a number of rubber vibration damping mounts 38 and 41. As depicted in FIGS. 5, 7, and 8, flanges 37 and 40 of the housing of the vibrator 26 are connected to the frame 33. A channel member 35 depends from one end of the top beam 36 of frame 33 and receives therein a flange 37 projecting from vibrator 26. Rubber vibration damping members 38 are anchored in channel 35 and at opposite sides of flange 37. A pair of upright rigid plates 39 project upwards from beam 36 at the end thereof opposite that from which channel member 35 depends. A flange 40 projects from vibrator 26 to and between plates 39. Rubber vibration damping members 41 are secured to opposite sides of flange 40 and to plates 39. A clevis 42 is secured to the central portion of top beam 36 by a swivel 43. As seen in FIG. 11, a retaining pin 44 may fix the clevis 42 in a selected rotational relationship with respect to top beam 36.

The housing of the vibrating member 26 includes a bottom plate 45 to which the tubular member 25 is secured. Tubular member 25 is elongated, rigid, and open at its ends, and may be of a length from 6 feet or less to 12 feet or more, and of a diameter from 2 feet or less to 4 feet or more. A rigid radial plate 46 spans the center of tube 25 at one end portion of tube 25 and projects endwise therefrom. A plurality of radial reinforcing plates 47 extend at different angles from the central portion of plate 46 to spaced points of tube 25. A top or end plate 48 is secured to and substantially perpendicular to the outermost margin of plate 46 and is reinforced by gusset plates 49 secured thereto and to plate 46. Plate 48 is adapted to be secured by bolts and nuts 50 to the bottom plate 45 of vibrator 26.

The clevis 42 provides means for pivotal connection of frame 33, through links 51, to the outer or free end of the pivoted control or suspension arm 21 of a backhoe 20.

It will be apparent from the foregoing description that the construction is strong and may be assembled and dismounted easily. The arrangement of the parts effecting connection of the backhoe arm, the vibrator, and the earth-vibrating tube is compact and thereby accommodates operation of the device with ample clearance under overhead wires. Also, the mounting of the vibrator upon the backhoe arm, characterized by the vibration damping members 38 and 41, minimizes transmission of vibration to the backhoe arm during the earth compacting operation. Other important features of the construction are that downward force may be exerted by the backhoe to supplement the gravitational force of the tube 25, to thereby speed the vibrational descent of the tube into the backfill material in the trench, and that the backhoe permits guidance and vertical positioning of tube 25 as it vibrates.

FIG. 12 depicts another embodiment of this invention. In this embodiment an hydraulic clamping device 60 having clamping jaws 61 is mounted on the base plate 45 of vibrator head 26 and is utilized to drivingly engage a radial plate 46' projecting from tubular member 25. Hydraulic clamping devices of this type are common to the art and are commonly used for gripping sheet pilings as they are being driven. As depicted in FIG. 12, the vibrator head and support structure of this invention could be used for the driving of sheet pilings as well as the compacting of backfill. In the driving of sheet pilings the orientation of the sheet piling with respect to the backhoe may be determined by placing retaining pin 44 in any one of multiple spaced holes 44' in top beam 36.

FIG. 13 depicts the way in which the backfill 24 overlying a pipe line 22 in a trench 23 is compacted by application of the tubular member 25 at successive positions along the trench. The grooves 29 and depressions at 31 resulting from the compaction are then filled by a relatively shallow layer of backfill material which is then rolled to grade level 28.

While the preferred embodiments have been illustrated and described it will be understood that other constructions which fall within the scope of the appended claims are contemplated to fall within the scope of this invention.

What I claim is:

1. A compactor comprising an elongated rigid tubular member open at its lower end, a power driven vibrator having a rigid housing with laterally spaced vertical flanges, a bottom plate, and eccentric weight means rotatable in said housing and positioned between said flanges, a transverse rigid beam having spaced channel members each receiving one of said vertical flanges, rubber damping members each anchored in a channel and to the received flange, a rigid member projecting upwardly from said tubular member and releasably secured to the bottom plate of said vibrator housing, and means carried by said beam substantially equally spaced from and between said flanges for releasably connecting said beam to a supporting vehicle.

2. A compactor as defined in claim 1, wherein said rigid projecting member includes a rigid radial plate spanning the upper part of said tube, a plurality of reinforcing members in said tube connecting said tube and radial plate, and a top plate carried by the upper end of said radial plate and secured to the bottom plate of said vibrator housing, said tubular member being open at its upper end.

3. A compactor as defined in claim 1, wherein one of said vibrator housing flanges projects upwardly from one end of said vibrator housing and the other flange projects from the other end of said vibrator housing, said beam mounted vehicle connection means projecting upwardly from the central portion of said beam.

4. A compactor as defined in claim 3, wherein said beam-mounted vehicle connection means constitutes a clevis rotatable on a vertical axis, and means anchoring said clevis in selected rotative position on said beam.

5. A compactor as defined in claim 1, wherein said vibrator housing flanges are positioned in said channels and vibration damping members are secured to said flanges at opposite sides thereof and are secured to said channels.

6. A compactor as defined in claim 1, wherein a clamp is carried by said vibrator housing for releasably gripping said rigid member.

7. A compactor as defined in claim 1, wherein said beam mounts a clevis substantially centrally thereof and between said flanges, said clevis being adapted for connection to said vehicle.

* * * * *